US009702131B2

(12) United States Patent
Gasca Salas

(10) Patent No.: US 9,702,131 B2
(45) Date of Patent: Jul. 11, 2017

(54) DISCHARGE SELECTOR FOR WATER-CLOSETS

(71) Applicant: Mario Alberto Gasca Salas, Ticumac (MX)

(72) Inventor: Mario Alberto Gasca Salas, Ticumac (MX)

( * ) Notice: Subject to any disclaimer, the term of this patent is extended or adjusted under 35 U.S.C. 154(b) by 57 days.

(21) Appl. No.: 14/762,340

(22) PCT Filed: Jan. 17, 2014

(86) PCT No.: PCT/MX2014/000012
§ 371 (c)(1),
(2) Date: Jul. 21, 2015

(87) PCT Pub. No.: WO2014/116096
PCT Pub. Date: Jul. 31, 2014

(65) Prior Publication Data

US 2015/0368890 A1 Dec. 24, 2015

(30) Foreign Application Priority Data

Jan. 25, 2013 (MX) ..... MX/a/2013/001023

(51) Int. Cl.
*E03D 3/12* (2006.01)
*E03D 1/14* (2006.01)
*E03D 1/30* (2006.01)

(52) U.S. Cl.
CPC ..... *E03D 3/12* (2013.01); *E03D 1/142* (2013.01); *E03D 1/306* (2013.01); *E03D 2001/148* (2013.01)

(58) Field of Classification Search
CPC E03D 3/12; E03D 1/142; E03D 1/306; E03D 1/22; E03D 2001/147
USPC ..... 4/324, 325, 385, 386
See application file for complete search history.

(56) References Cited

U.S. PATENT DOCUMENTS 2,615,174 A 10/1952 Barling et al.
3,003,156 A * 10/1961 Alexander ..... E03D 1/306 4/386
4,160,294 A * 7/1979 Crumby ..... E03D 1/144 4/324

(Continued)

FOREIGN PATENT DOCUMENTS

MX WO 2011049423 A2 * 4/2011 ..... E03D 1/144
WO 2011049423 A2 4/2011

*Primary Examiner* — Erin Deery
(74) *Attorney, Agent, or Firm* — Edell, Shapiro & Finnan, LLC

(57) ABSTRACT

The invention relates to a discharge selector for water-closets, that allows the control of the discharge of water from the cistern of the water-closet into the bowl, in two different proportions, which allows less water to be used when liquids are to be removed from the bowl and a larger proportion of the content of the cistern to be discharged when solids are to be removed from the bowl. Said device consists of a single part provided with mechanisms that allow it to operate in the described manner and also allows the quantity of water discharged to be adjusted within a certain range. The device is universally applicable and does not leak water even if the packaging loses elasticity. The device can be installed by the user thereof as the installation is just as easy as that of the replacement flap in any currently commonly used discharge valve.

12 Claims, 4 Drawing Sheets

(56) References Cited

U.S. PATENT DOCUMENTS

| | | | | |
|---|---|---|---|---|
| 4,189,795 | A * | 2/1980 | Conti | E03D 1/142 137/403 |
| 5,173,971 | A * | 12/1992 | Schoepe | E03D 1/306 4/378 |
| 5,375,268 | A | 12/1994 | Chen | |
| 6,263,520 | B1 * | 7/2001 | Song | E03D 5/092 4/324 |
| 6,401,269 | B1 * | 6/2002 | Andersen | E03D 1/308 4/379 |
| 6,571,401 | B2 * | 6/2003 | Comparetti | E03D 1/142 4/325 |
| 6,742,194 | B2 * | 6/2004 | Shim | E03D 1/306 4/325 |
| 7,757,708 | B1 | 7/2010 | Canfield et al. | |
| 2004/0172746 | A1 | 9/2004 | Nichols-Roy et al. | |

* cited by examiner

DISCHARGE SELECTOR FOR WATER-CLOSETS

CROSS-REFERENCE TO RELATED APPLICATIONS

This application is a 35 U.S.C. §371 National Phase Entry Application from PCT/MX2014/000012, filed Jan. 17, 2014, and designating the United States, which claims priority to Mexican Application No. MX/a/2013/001023, filed Jan. 25, 2013, the disclosures of which are incorporated herein by reference in their entirety.

BACKGROUND OF THE INVENTION

The increasing consumption of potable water resulting from population growth in nearly all countries of the world results in a variety of problems such as the increase in distribution costs as well as the pollution generated by the high consumption of energy to carry it from its source to the places where it is consumed. These places generally are not near the source, and are often high above sea level. This is why the search for means for saving potable water consumption and making it more efficient has led to the creation of numerous devices, among which are those used to save water in toilets. The most advanced among those systems consist of discharge valves that control the outlet of water from their tanks so as to limit the outlet of water when liquids must be removed from the toilet bowl, and enable the total evacuation thereof when solid waste must be removed. However, these systems are composed of a large number of parts and their installation requires the removal of parts such as the control lever of the discharge valve of the tank and the body of the valve, which in turn requires the removal of the toilet tank itself. These difficulties make it necessary to hire specialized personnel. The foregoing makes the system susceptible to failures, and they are expensive not only due to their high prices but also due to the fact that their installation involves extra expense. This makes them rather unattractive for users, which prevents the propagation of their use.

The purpose of this invention is to resolve these and other disadvantages by means of a discharge selector for toilets like the one shown here, the characteristics of which are focused on the fact that it is composed only of the flap, which makes it economical and therefore accessible to potential users. Its installation is very easy since this can be done simply with the hands. Moreover, thanks to its articulated gasket it can be installed in most toilet tanks irrespective of the type of discharge valve they may have. In addition, because its operation takes advantage of the flotation principal and the action of the force of gravity, it is failure-free.

BRIEF DESCRIPTION OF THE DRAWINGS

The characteristic details of this novel discharge selector for toilets are clearly seen in the following description and in the drawings that accompany it as a graphic representation thereof, and in which the same signs are used to indicate the same parts of which it is composed. In these figures the following has been represented by way of non-limiting illustration.

DESCRIPTION OF THE INVENTION

With reference to these figures, said discharge selector for toilets is composed of three principal parts, namely the structure, the gasket and the discharge distribution mechanism.

Figure 1:
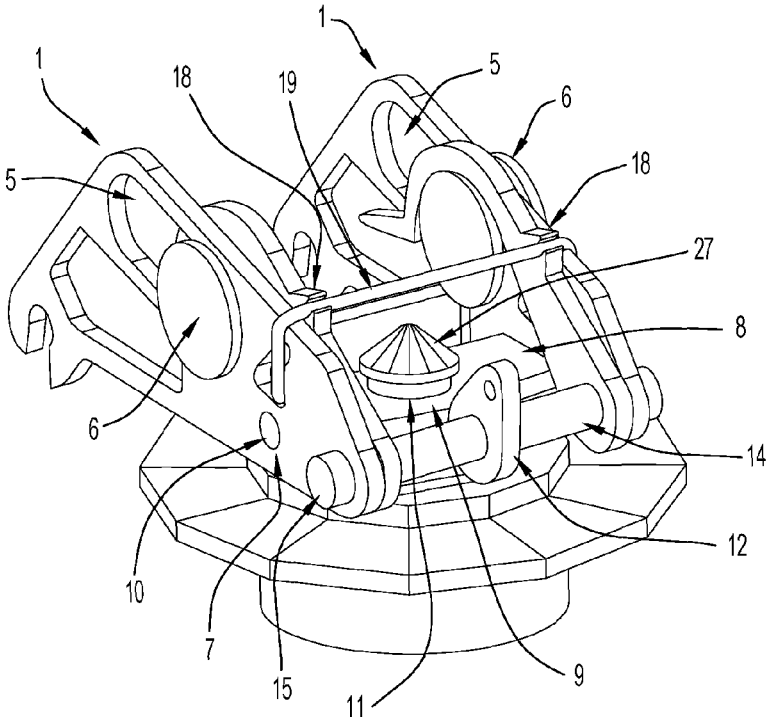
FIG. 1 shows a front view in perspective of said discharge selector for toilets.
Figure 2:
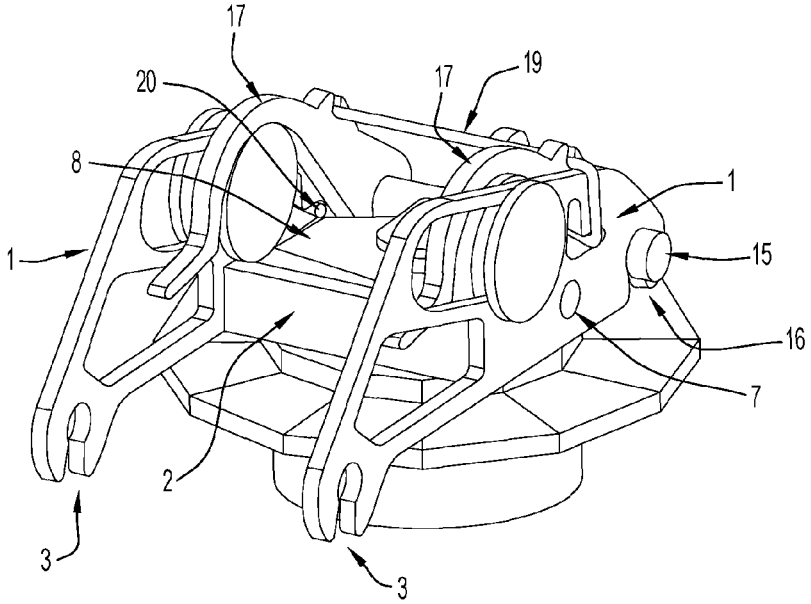
FIG. 2 shows another perspective view of said discharge selector for toilets viewed from behind.
Figure 3:
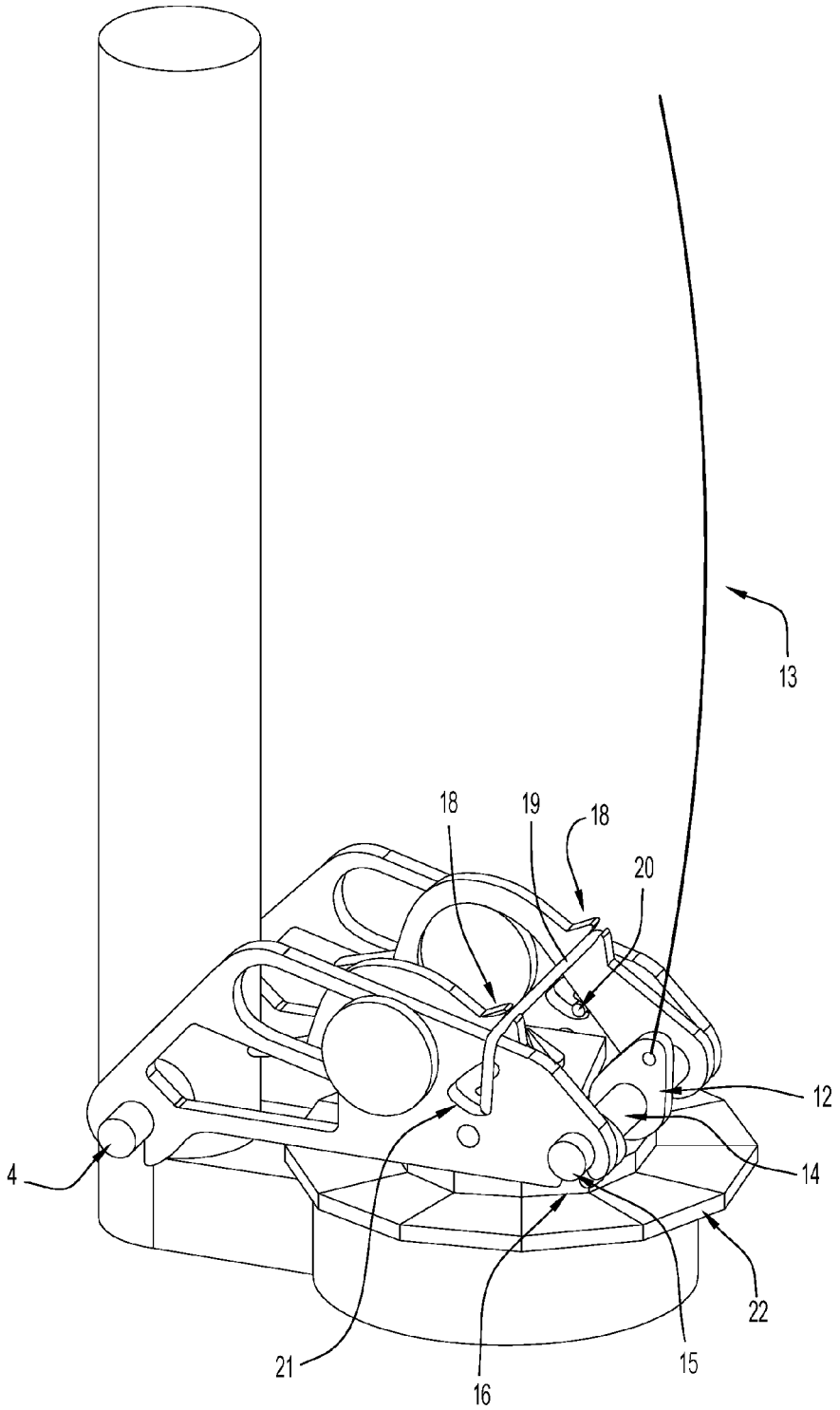
FIG. 3 shows another perspective of said discharge selector for toilets installed in the body of a discharge valve when it is closing off the passage of water.
Figure 4:
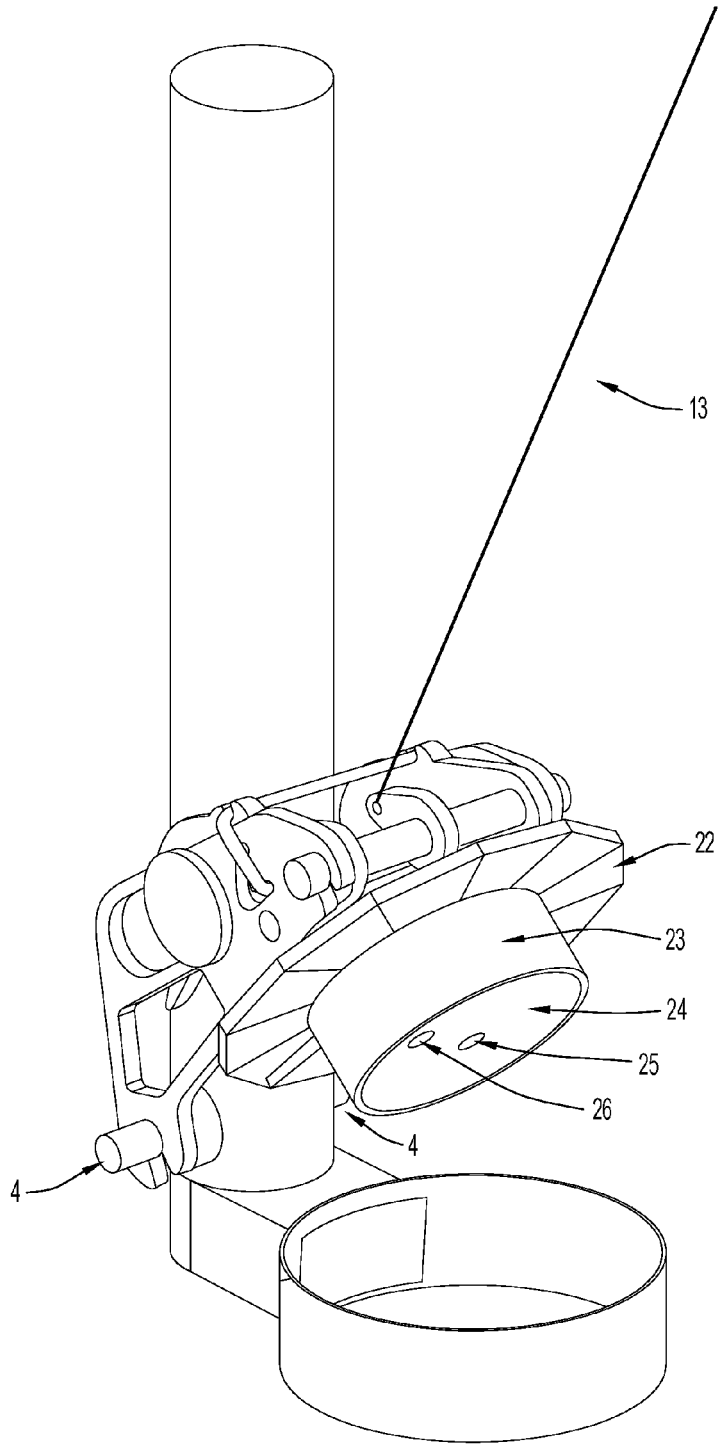
FIG. 4 shows another perspective of said discharge selector for toilets installed in the body of a common discharge valve when the control line has been pulled one time and the weights remain in the front position forcing the closure of the valve.

The first part, the structure, is made of a synthetic polymer and has a basic "H" shape when viewed from above. It is formed by two walls (1) parallel to each other and of greater length and height, and another member (2) of much smaller height perpendicular to the walls (1), which member separates said walls and provides integrity to the structure. When viewed from the side the walls (1) of greater length and height have an extension in the posterior and descending direction with respect to the structure itself, in which bay-shaped cuts (3) are made, i.e. cuts that are circular in form and open at their lower part. The purpose of said cuts (3), as shown in FIG. 2, is to enable said discharge selector for toilets to be assembled onto the opposite horizontal bolts (4) of the overflow tubes of commonly used discharge valves most existing toilets have on the market today. Said walls (1) of greater length and height have in their upper central portion an oblong hole (5) of large diameter, the axis of which has a downward direction towards the front portion of the structure, each of which oblong holes (5) accommodates a spool-shaped weight (6) made of a metal material that is corrosion-proof or has had anti-corrosion treatment, which is confined by its "waist" after being inserted under pressure into the oblong holes (5) but with the possibility of rolling over the length of said holes (5), that is, forwards or backwards. Both walls (1) of greater length and height have a hole (7) of smaller diameter located in the mid-portion which starts from the member (2) of much smaller height and ends at the front end of the walls (1). The purpose the smaller hole (7) is to allow the assembly by pressure of a rhombus-shaped plate (8) which in turn has a circular hole (9) at its geometric center and two cylindrical projections (10) of a smaller diameter than that of the aforementioned holes (7). Thus, said rhombus-shaped plate (8) serves to receive in its circular hole (9), assembled by insertion under pressure, the projection (11) in the upper part of the gasket which, in this way, is assembled and articulated within the angular range towards the rear part imposed upon it by the member (2) of smaller height and towards the front the link (12) for attaching the control line (13). Said link (12) forms an integral part of the shaft of the discharge distribution mechanism, which shaft (14) has in the vicinity of its ends reductions in its diameter (15), the purpose of which is its assembly under pressure and articulation in the bay-shaped cuts (16), the openings of which point downwards and are made in the front ends of the parallel walls of greater length and height (1). The discharge distribution mechanism also includes, in the vicinity of both ends of its shaft (14), hooks (17), contained in the vertical plane, the thickness of which is similar to that of the walls (1) of the structure and the outer faces of which share a plane with the faces of the reductions in diameter (15) of the shaft (14) of the distribution mechanism itself. Said hooks (17), accommodated inside the parallel walls (1) of the structure, can move angularly in the vertical plane the center of which is the aforementioned bay-shaped cuts (16). The purpose of the hooks (17) is to restrain the spool-shaped weights (6) that move freely within the oblong holes (5) in each of the parallel walls (1) when it is desired to perform a limited discharge in the toilet bowl in order to economize on water consumption. In turn, the hooks (17) have, in the mid-portions of the arms that connect them to the shaft of the discharge distribution mechanism (14) and at their upper edge, bay-shaped cuts (18) the openings of which point upwards and in which is inserted the upper side of a horizontal rectangle of wire (19) the lower side of which is discontinuous. The ends (20) of said wire (19) are inserted in the "L" shaped apertures (21) in the walls (1) the purpose of which is to control the angular movement of the hooks (17) since, when the structure is in the closed, i.e. horizontal or quasi-horizontal position, and the control line (13) is pulled, the attachment link (12) via the cylindrical shaft (14) lifts the hooks (17) of the discharge distribution mechanism, the ends (20) of the horizontal wire rectangle (19) turn by action of the force of gravity until the horizontal portions of the apertures (21) hold the discharge distribution mechanism in that position, thus preventing the hooks (17) from turning upwards and releasing the spool-shaped weights (6). Thus the weight and position of said spool-shaped weights (6) towards the front of the structure force the discharge selector to close the valve prematurely by its gasket, as shown in FIGS. 3 and 4 respectively. In turn, when the selector is in the open position pointing diagonally upwards and the control line (13) is pulled again, because of the force of gravity the ends (20) of the wire rectangle (19) are moved backwards and under the effect of the pull on the line (13) itself they are moved upwards in the vertical portion of the aperture (21), resulting in the hooks (17) of the discharge distribution mechanism turning upwards, releasing the backwards and downwards movement of the spool-shaped weights (6), which nullifies the effect of premature closing of the valve. Thus, by operating the lever of the toilet one time, less water is discharged, and if it is operated twice consecutively the full contents of its tank is discharged.

Figure 5:
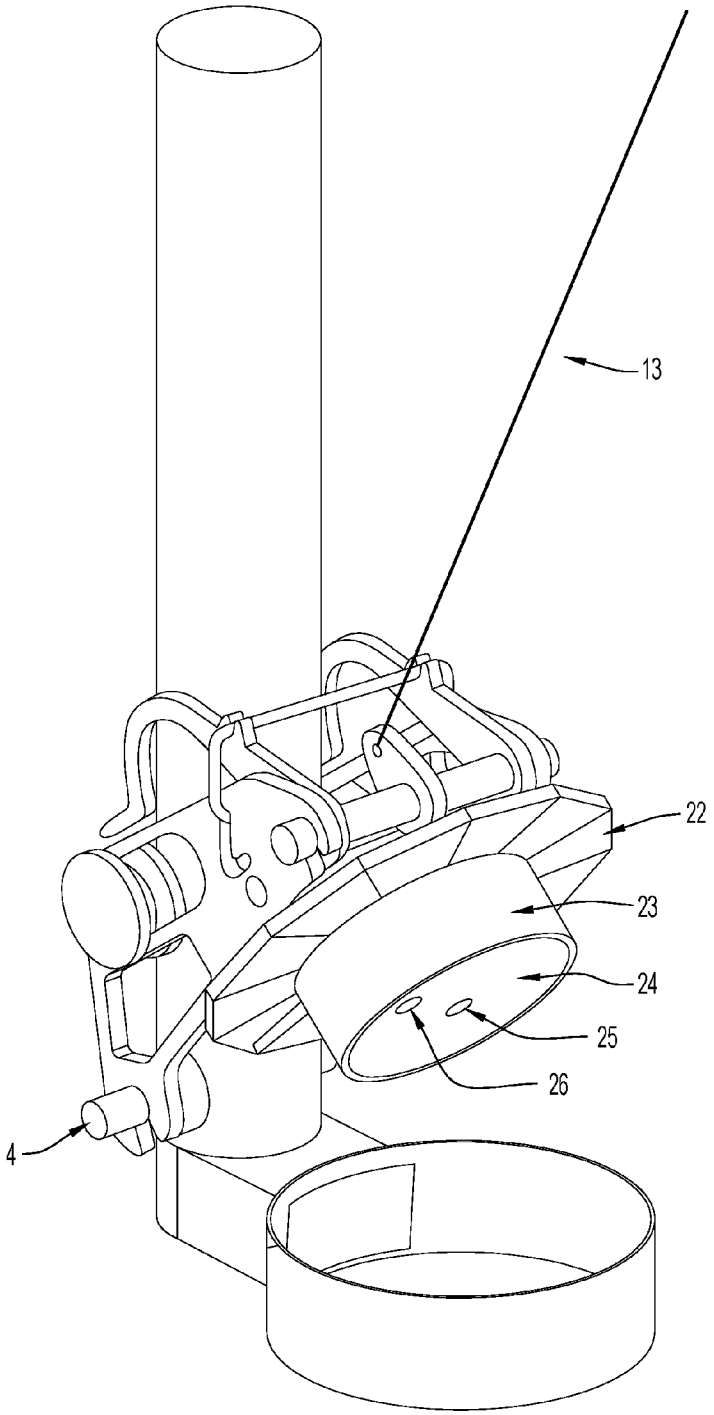
FIG. 5 shows another perspective of said discharge selector for toilets installed in the body of a common discharge valve when the control line has been pulled two consecutive times and the weights have been moved backwards.

The last of the components is the gasket per se, which consists of a rotatable disk-shaped part (22) which has a hollow cylindrical projection (23) on its lower face. Inserted by pressure-fit into said cylindrical projection is the cover (24), which in turn has two perforations, one centered (25) and the other near at its periphery (26). The functions of said perforations are to permit the entry of water in a controlled manner, since the one located in a higher position (26), as shown in FIGS. 4 and 5, allows air to exit while the other perforation (25) allows water to enter. Thus, by rotating the gasket the closing time of the valve can be changed by varying the floatability of the chamber formed by the hollow cylindrical projection (23) and its respective perforated cover (24). For its assembly in the circular hole (9) of the rhomboid-shaped flat part (8), the gasket has a circular projection topped by a pyramid (27) with a circular base, which base has a diameter that is slightly greater than the one of the circular projection (11). When the pyramid (27) with circular base is inserted under pressure into the circular hole (9) of the rhomboid-shaped part (8), it prevents the gasket from becoming detached.

Having sufficiently described my invention as set forth above, I consider it as a novelty and therefore claim as my exclusive property the contents of the following clauses:

1. A discharge selector for toilets with a toilet tank, the discharge selector comprising:

two vertical walls disposed parallel to one another, each vertical wall including an elongate hole formed in an upper portion of the respective vertical wall and having a long axis descending from a rear portion of the respective vertical wall toward a front portion of the respective vertical wall, each vertical wall further including an L-shaped aperture formed forwardly of the elongate hole, a rear opening formed in the rear portion of the respective vertical wall to fit onto a bolt in the toilet tank, and a front opening formed in the front portion of the respective vertical wall;

a transverse member extending between the vertical walls; and a discharge distribution mechanism extending between the front openings in the two vertical walls.

2. The discharge selector of claim 1, wherein the discharge distribution mechanism includes a rotatable shaft extending between the front openings in the two vertical walls and two hooks mounted on the rotatable shaft.

3. The discharge selector of claim 2, further comprising two weights, one of which is disposed in the elongate hole formed in a first of the two vertical walls, and the other of which is disposed in the elongate hole formed in a second of the two vertical walls, wherein the weights are configured to move freely in the elongate holes.

4. The discharge selector of claim 3, wherein the weights are spool-shaped.

5. The discharge selector of claim 3, further comprising a wire connected to the hooks, the wire having an upper portion extending transversely across the hooks, side portions extending downwardly from the hooks, and ends extending into the L-shaped apertures in the vertical walls.

6. The discharge selector of claim 5, further comprising an attachment link extending from the shaft of the discharge distribution mechanism and configured to connect with a control line of the toilet.

7. The discharge selector of claim 6, wherein the hooks are configured to be able to retain the weights in a front end of the elongate holes in a downwardly rotated position and to release the weights to move freely within the elongate holes in an upwardly rotated position, and wherein the L-shaped apertures are oriented such that ends of the wire serve to restrict movement of the weights when in respective lower parts of the L-shaped apertures and free the weights for movement when in respective upper parts of the L-shaped apertures, when the attachment link is pulled by the control line.

8. The discharge selector of claim 1, further comprising a gasket including a rotatable disk-shaped part with a lower face, and a hollow cylindrical projection with a cover, wherein a first perforation is formed in a center of the cover and a second perforation is formed near a periphery of the cover.

9. The discharge selector of claim 8, further comprising a rhomboid-shaped plate extending between the two vertical walls, wherein a hole is formed in the rhomboid-shaped plate and the gasket includes a projection that extends through the hole in the rhomboid-shaped plate to allow the gasket to rotate and a pyramidal or cone shaped portion at an upper end of the projection with a base having a dimension larger than the hole.

10. The discharge selector of claim 9, wherein the rhomboid-shaped plate includes projections that fit within openings formed in the two vertical walls and allow the gasket to be articulated, enabling correct seating of the gasket in a mouth of different toilet valves.

11. The discharge selector of claim 1, wherein an apex of each L-shaped aperture points toward a rear portion of the respective vertical wall in which the aperture is formed.

12. The discharge selector of claim 1, wherein one or more of the group comprising the two vertical walls, the transverse member, and the discharge distribution mechanism are made of a synthetic polymer.

* * * * *